United States Patent [19]

Fronduti

[11] Patent Number: 4,641,777

[45] Date of Patent: Feb. 10, 1987

[54] PRISMATIC CONTAINER OBTAINED FROM A FLAT CARDBOARD BLANK WITH A DIAPHRAGM END CLOSURE DEVICE FORMED BY STAMPING A PART OF THE FLAT BLANK

[75] Inventor: Domenico Fronduti, Città di Castello, Italy

[73] Assignee: Cartotecnica Tifernate S.p.A., Citta di Castello, Italy

[21] Appl. No.: 629,882

[22] Filed: Jul. 11, 1984

[30] Foreign Application Priority Data

Jul. 11, 1983 [IT] Italy ..... 35952/83[U]
Jul. 11, 1983 [IT] Italy ..... 35953/83[U]

[51] Int. Cl.[4] ..... B65D 5/32

[52] U.S. Cl. ..... 229/110; 229/19; 229/23 BT; 229/41 C

[58] Field of Search ..... 229/39 B, 41 C, 41 D, 229/9, 19, 43, 23 R, 23 BT, 37 R, 22; 221/305; 220/416

[56] References Cited

U.S. PATENT DOCUMENTS

| | | | |
|---|---|---|---|
| 1,269,918 | 6/1918 | Fietsch, Jr. | 229/37 R |
| 2,577,588 | 12/1951 | Paige | 220/416 |
| 2,715,509 | 8/1955 | Paige | 248/174 |
| 2,808,193 | 10/1957 | Michalka | 229/39 B X |
| 2,991,922 | 7/1961 | Wilson | 229/41 C X |
| 3,237,840 | 3/1966 | Keith | 229/43 X |
| 3,246,800 | 4/1966 | Stone | 221/305 |
| 3,254,826 | 6/1966 | Keith | 229/43 X |
| 3,384,222 | 5/1968 | Franco | 229/39 B |
| 3,556,385 | 1/1971 | Kato | 229/8 X |
| 3,661,319 | 5/1972 | Koehler | 229/41 C X |
| 3,750,934 | 8/1973 | Clinage | 229/39 B |
| 3,973,724 | 8/1976 | Stone | 229/41 C |
| 4,032,062 | 6/1977 | Kawai et al. | 229/39 R |
| 4,160,519 | 7/1979 | Gorham | 229/23 R |
| 4,391,366 | 7/1983 | Hirata | 229/41 C |

FOREIGN PATENT DOCUMENTS

| | | | |
|---|---|---|---|
| 657891 | 2/1963 | Canada | 229/41 C |
| 2901616 | 7/1980 | Fed. Rep. of Germany | 229/22 |
| 1354881 | 2/1964 | France | 229/41 C |
| 853891 | 11/1960 | United Kingdom | 229/39 B |

*Primary Examiner*—William I. Price
*Assistant Examiner*—Gary E. Elkins
*Attorney, Agent, or Firm*—Fleit, Jacobson, Cohn & Price

[57] ABSTRACT

A container of prismatic form, in particular for loose sweetmeat products, obtained starting from a unitary flat blank or from two cardboard flat blank parts, in which the opening and closure respectively of the container itself for withdrawal of the product contained therein takes place by telescopically sliding one part of the assembled blank over the other part thereof, this sliding causing, in accordance with the direction in which it takes place, opening or closure of one end of the container by means of a substantially diaphragm device formed by means of particular shaping by die cutting of a part of the unitary flat blank or one of the two flat blank parts.

7 Claims, 7 Drawing Figures

PRISMATIC CONTAINER OBTAINED FROM A FLAT CARDBOARD BLANK WITH A DIAPHRAGM END CLOSURE DEVICE FORMED BY STAMPING A PART OF THE FLAT BLANK

FIELD OF THE INVENTION

This invention relates to containers for loose sweetmeats or the like, such as, for example, chocolates, caramels, pastilles, sugared almonds, etc., which can be formed from a single piece flat blank or from two flat blank sections for example of cardboard, by means of folding along pre-arranged score lines, gluing and assembly of the said blank, the said container having, once assembled, a substantially prismatic form.

OBJECTS OF THE INVENTION

The object of the present invention is to provide a container the opening of which, necessary for removing the desired quantity of product, will be easy and certain, and the closure of which, once such removal has been effected, will be likewise easy and certain and will prevent the accidental escape of the produce contained therein.

GENERAL DESCRIPTION OF THE INVENTION

According generally to the present invention, the opening and closing of such a container both take place by telescopic sliding of one part of the assembled blank over another part thereof, such sliding determining the opening and closing respectively of one end of the container by means of a substantially diaphragm type device formed by particular shaping by means of die-cutting of a part of the flat unitary blank or of one of the two flat blank sections.

Containers according to the present invention can be made with numerous constructional details which make its assembly easy and certain both manually and with the use of automatic or semi-automatic machines.

SPECIFIC DESCRIPTION OF PREFERRED EMBODIMENTS

Containers of the present invention will now be described in detail, by way of example, with reference to the attached drawings, in which.

Figure 1:
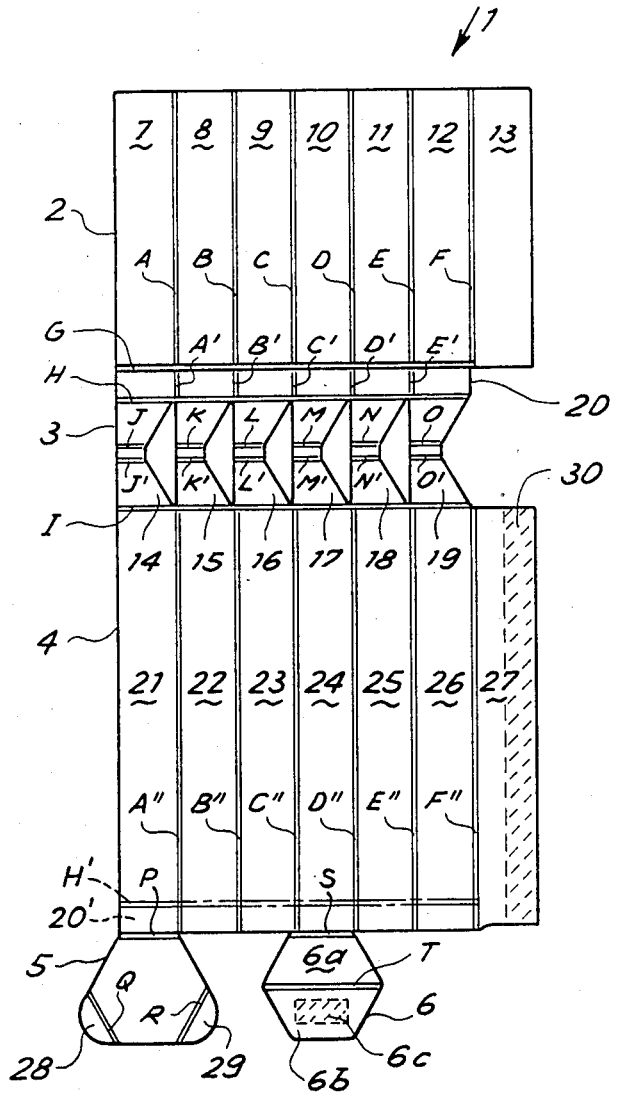
FIG. 1 is a plan view of a unitary flat blank which, in a preferred embodiment of the invention, is intended to constitute the container of the present invention.

With reference to FIG. 1, the flat unitary blank 1 for obtaining a container of substantially prismatic form comprises:

an upper part 2 sub-divided into equal rectangular panels 7,8,9,10,11 and 12 by longitudinal score lines A,B,C,D and E. A further longitudinal score line F delimits a terminal alteral flap 13 intended to be provided with adhesive on the other side for gluing to the surface of the panel 7 shown in the drawing and of substantially equal dimensions to those of the panels from 7 to 12;

a central part 3 delimited at the top by the transverse score line G, common to the upper part 2 and which has a further transverse score line H close to the transverse score line G and parallel to this score line. The central part 3 is sub-divided into shaped panels 14,15,16,17,18 and 19 which constitute a prolongation of the corresponding panels from 7 to 12 of the upper part 2, delimited in length by the transverse score lines H and L, and which define spaces formed by die cutting in the form of isosceles trapezoids the longer bases of which are constituted by the ideal continuation of the longitudinal score lines from A to F of the upper part 2 in the section lying between the transverse score lines H and I, and the smaller bases of which have a length of minimum dimensions. Pairs of close transverse parallel score lines J-J', K-K', L-L', M-M', N-N' and O-O' traverse corresponding panels from 14 to 19 in their median part, coinciding with the ends of the smaller bases of the isosceles trapezoids forming the said spaces. The transverse strip 20 of the central part 3 of the flat blank 1, delimited by the transverse score lines G and H, has longitudinal score lines A',B',C',D' and E' aligned with corresponding longitudinal score lines from A to E of the upper part 2 of the flat blank 1. In accordance with the present invention the length of the central part 3 of the flat blank 1 is determined in relation both to the width of any one of the panels from 7 to 12 of the upper part 2 and the distance between the transverse parallel score lines from J-J' to O-O' of the central part 3;

a lower part 4 sub-divided into equal rectangular panels 21,22,23,24,25 and 26 which constitute the prolongation of corresponding panels from 14 to 19 of the central part 3 by longitudinal parallel score lines A'',B'',C'',D'' and E'' aligned with corersponding parallel longitudinal score lines from A' to E' of the central part 3 and therefore with the corresponding lines from A to E of the upper part 2. A further longitudinal score line F'', aligned with the corresponding longitudinal score line F of the upper part 2, delimits a flap 27 of substantially the same dimensions as those of one of the panels from 21 to 26, intended to have adhesvie applied to the hatched zone 30 shown in the drawing and then to be stuck to the other side of the panel 21;

a projection 5 of a pseudo-trapezoidal form joined to the panel 21 along the whole of the smallest side thereof by a transverse score line P, the said projection 5 having two further score lines Q and R which define a hexagon within the projection itself, having sides of length equal to the width of any one of the panels from 21 to 26, in such a way as to delimit two lower lateral flaps 28 and 29 in the form of small ears;

a projection 6, joined to the panel 24 along the whole of the lower sides thereof by a transverse score line S, and constituted by a hexagon having sides of length equal to the width of any of the panels from 21 to 26, the said projection 6 being sub-divided into two halves constituted by counterposed trapezoids 6*a* and 6*b* by means of a transverse score line T, there being a zone 6*c*, hatched in the drawing, of the trapezoidal half 6*b* intended to be provided with adhesive and then glued to the corresponding opposite side of the projection 5.

Still making reference to FIG. 1, the stamping, folding, gluing and assembly of the flat blank 1 takes place as follows.

Since the upper part 2 of the flat blank 1 is intended to be folded back along the transverse lower end score line G towards the reverse face of the central part 3 and the lower part 4 of the flat blank 1 and therefore the surface of the upper part 2 shown in the drawing will become disposed on the outside of the container once assembled, the stamping will take place "in white" (that is to say on the front face) as far as the said upper part 2 is concerned whilst it will take place on the other side (or rather on the reverse face) as far as the remaining parts of the flat blank 1 constituted by the central part 3, the lower part 4 and the projections 5 and 6 are concerned.

Once the flat blank 1 has been stamped as explained above, the upper part 2 is folded by hand or by machine along its transverse terminal lower score line G towards the back of the central part 3 until the reverse face of the upper part 2 comes into contact with the corresponding rear faces of the central part 3 and lower part 4 of the flat blank 1.

A layer of adhesive, for example of the vinyl type or else of the so-called "hot melt" type is applied by hand or machine to the reverse face of the edge flap 13 of the upper part 2 along a longitudinal strip adjacent to its edge as well as along the longitudinal strip 30 adjacent the outer edge of the flap 27 of the lower part 4 and on the zone 6*c* of the projection 6.

The projection 5 is now folded along the transverse score line P towards the inside. The projection 6 is therefore folded, always towards the inside, along the transverse score line S, whilst its half 6*b* is folded, on the other hand, outwardly along the transverse score line T; the surface shown in the drawings of the half 6*a* of the projection 6 will therefore find itself in contact with the lower surface shown in the drawing of the panel 24, whilst the half 6*b* and therefore the zone 6*c* provided with adhesive, is facing outwardly.

The flat blank 1 is now folded a first time along the longitudinal score line B" and, a second time, along the longitudinal score E", paying attention to inserting the glued flap 27 of the lower part between the rear face of the panel 21 of the said lower part 4 and the opposite face to that shown in the drawing of the panel 7 of the upper part 2, as well as to superimposing the opposite face from that shown in the drawing of the edge flap 13 of the upper part 2, suitably provided with adhesive as mentioned, over the corresponding front face shown in the drawing of the panel 7 of the said upper part 2 of the flat blank 1.

By means of pressure there is obtained the gluing of the rear face of the edge flap 13 on to the panel 7 of the upper part 2, of the longitudinal strip 30 of the flap 27 onto the rear face of the panel 21 of the lower part 4, as well as the glued zone 6*c* of the projection 6 onto the rear face of the projection 5.

The thus folded and glued flat blank 1 gives rise to a flexible container having two dimensions of minimum size and therefore easily stored, ready to be easily transformed into a three dimensional container by exercising manually or by machine, a pressure along the opposite edges of the container corresponding to the longitudinal score lines B and E respectively B" and E" of the upper part 2 and lower part 4 of the flat blank 1, thus obtaining the final assembly of the container, open at one end and closed at the other by means of the positioning of the projection 6 perpendicularly with respect to the walls of the container by the effect of the pressure exerted on its opposite edges and by means of the contemporaneous automatic positioning, by the effect of the gluing on the projection 6, of the projection 5 the flaps 28 and 29 of which facilitate its sliding in the way of guides and ensure the perfect closure of the corresponding end of the container itself.

The container according to the present invention is now ready to be filled with the desired products and then closed.

The closure of the container according to the present invention takes place by means of the telescopic sliding of the upper part 2 over the lower part 4 in the only sense possible and that is to say towards the end of the container closed by the projections 5 and 6. In fact, since the said two parts of the flat blank 1 forming the container are rigidly connected along the transverse score line G and since the strip 20 of the central part 3 unavoidably assumes a position against the rear surface of the upper part 2 by the effect of the folding of the longitudinal scores from A' to E', this sliding causes the folding of the shaped panels from 14 to 19 of the central part 3 along the respective pairs of transverse parallel score lines from J-J' to O-O' which traverse them, thus causing a closure movement substantially like a book of these panels, the particular shape of which allows displacement towards the longitudianl axis of the container of the median part as well as the partial superimposition of the panels themselves, thereby causing the closure of the associated end of the container with a substantially diaphragm effect by the arrangement of the said panels perpendicularly with respect to the axis of the container.

Figure 2:
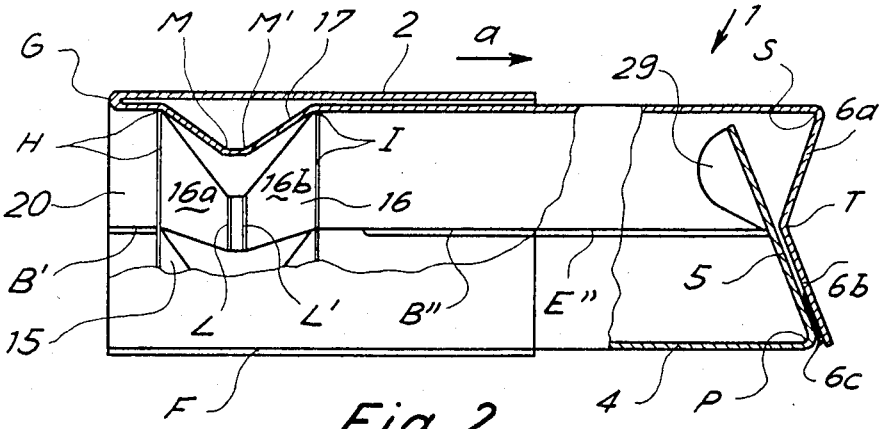
FIG. 2 is a partially sectioned side view of the container formed from the flat blank of FIG. 1 in its three dimensional form and shown closed.
Figure 5:
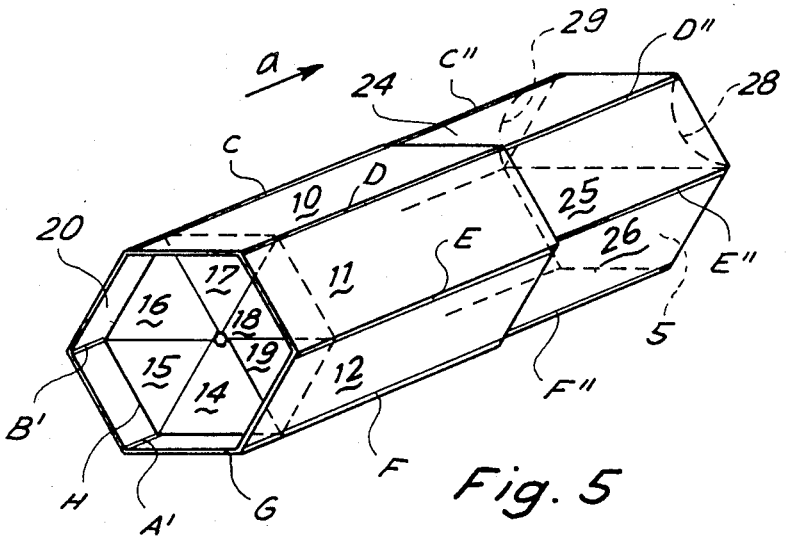
FIG. 5 is a persepctive view of the container of the present invention in its threedimensional form, shown in a closed position.

For a better understanding of the functioning of the closure device, which opens when moved in the opposite sense, reference is made to FIGS. 2 and 5.

In particular, with reference to FIG. 2, the substantially book-like closure of the panel 16 of the central part 3 of the flat blank 1 along the corresponding parallel transverse score lines L–L' is to be noted. Once closure has taken place the part of the panel 16 indicated 16*a* in the drawing will be disposed perpendicularly with respect to the longitudinal axis of the container, the surface of the part of the panel 16 lying between the score lines L–L' will be disposed close to the longitudinal axis of the container and in a position substantially parallel thereto, whilst the part of the panel 16 indicated 16*b* in the drawing will be disposed in a position substantially parallel to the part 16*a*.

The arrow a indicates the direction of telescopic sliding of the upper part 2 over the lower part 4 of the thus-assembled flat blank 1 for closure of the container.

Still with reference to FIG. 2, the scoring of the edge G which joins the upper part 2 and central part 3 of the flat blank 1 is to be noted in particular.

In FIG. 5 there is shown the end of the container according to the present invention closed with the "diaphragm" device obtained by the particular shaping of the central part 3 as described and illustrated above.

Advantageously, for the purpose of permitting an easier closure and/or opening of the diaphragm device, there may be formed light cuts along the transverse scores H and I, as well as along the transverse scores from J–J' to O–O', in such a way as to reduce suitably the hinge effect resistance. Further, light cuts are envisaged at the upper ends of the longitudinal score lines from A" to E" close to the transverse score line I.

Here below there will now be described and illustrated a further embodiment of the container according to the invention.

Figure 3:
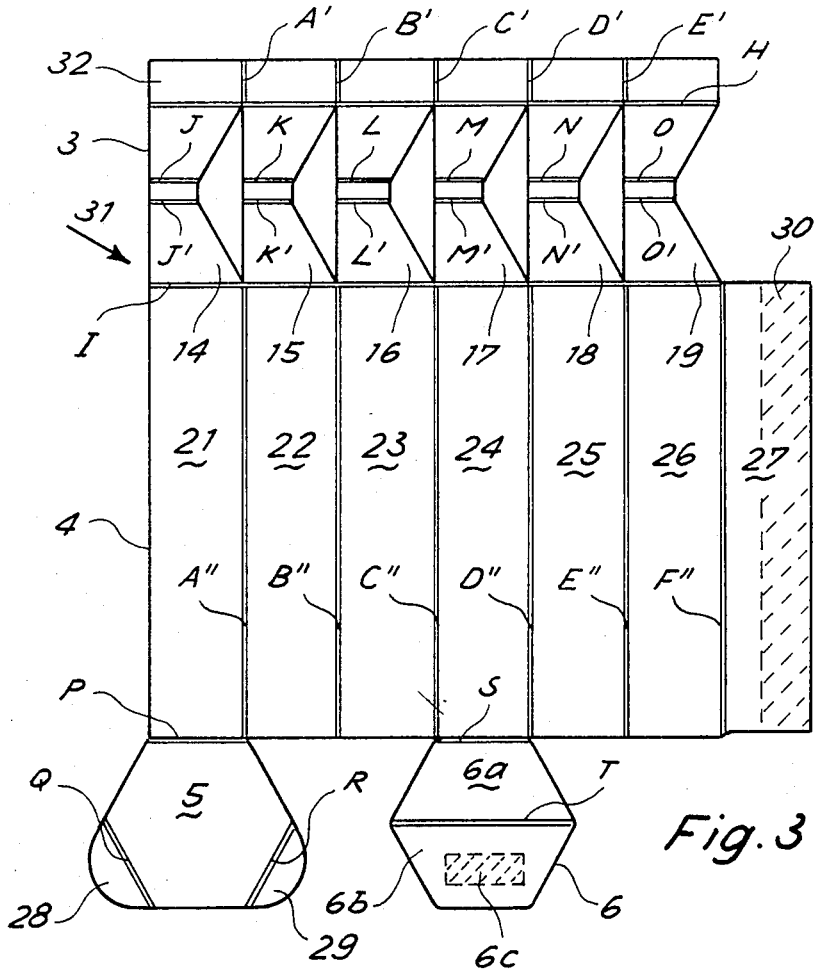
FIG. 3 is a plan view of the part of the flat cardboard blank intended to constitute the inner part of the container of a further embodiment of the invention.
Figure 4:
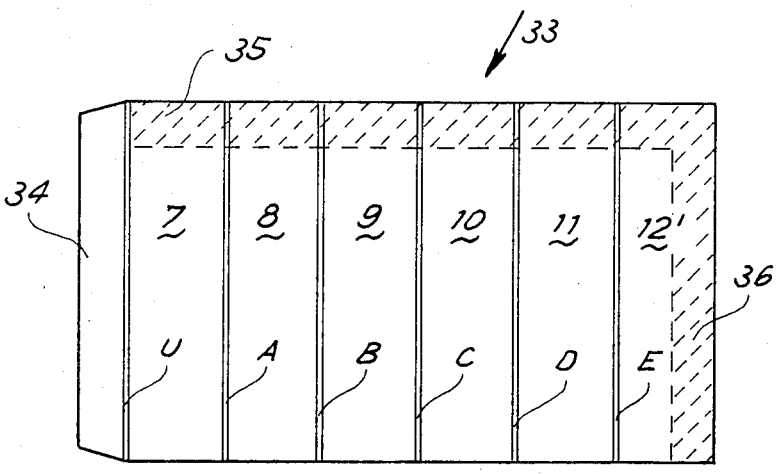
FIG. 4 is a plan view of the flat cardboard blank intended to constitute the outer part of the container of the further embodiment of the invention shown in FIG. 3.

According to this further embodiment, the container of the invention is obtained starting from two flat cardboard blanks, the first of which, shown in FIG. 3, is intended to form the inner part of the assembled container, whilst the second, illustrated in FIG. 4, is intended to form the outer part thereof.

In FIGS. 3 and 4 the same elements as those of the flat unitary blank of FIG. 1 are indicated with the same reference numerals.

As shown in FIG. 3, the flap blank part 31 intended to form the inner part of the container of the invention is the same as the corresponding central part 3, lower part 4 and projections 5 and 6 of the unitary flat blank of FIG. 1.

In FIG. 4 there is shown the flat blank part 33 which has a substantially rectangular form, intended to form the outer part of the container of prismatic form of the invention. The longitudinal score lines A,B,C,D and E sub-divide the flat blank part 33 into panels 7,8,9, 10,11 and 12', the width of the corresponding panels from 21 to 26 of the part 4 of the flat blank 31 of FIG. 3, in such a way as to be able to be superimposed on and slide on these latter. A further longitudinal score line U delimits a flap 34 having upper and lower edges tapering outwardly, having a width less than that of the panels and the reverse face of which is intended to be joined by gluing to the glued strip 36, hatched in the drawing, adjacent to the edge of the panel 12'. The glued strip 35 hatched in the drawing adjacent the upper edge of the panels from 7 to 12', is intended to be glued to the reverse face of the zone 32 of the part 3 of the flat blank part 31, thus completing the assembly of the two flat blank parts 31,33.

The gluing, folding and assembly of the two flat blank parts 31 and 33 is as follows.

With reference to the flat blank part 31 the inner surface of which is shown in plan in FIG. 3, an adhesive layer, for example of the vinyl or of the so-called "hot melt" type, is applied by hand or machine to the flap 27 and the zone 6*c* of the projection 6. The projection 5 is subsequently folded along the transverse score line P towards the inside. The projection 6 is then folded, again towards the inside, along the transverse score line S, whilst its half 6*b* is folded in the opposite direction outwardly; the inner surface of the half 6*a* of the projection 6 will thus find itself in contact with the lower inner surface of the panel 24, whilst the half 6*b* and therefore the glued zone 6*c* is located facing towards the outside. The flat blank part 31 is now folded a first time along the longitudinal score line B" and a second time, along the longitudinal score line E" in such a way that the flap 27 is stuck by pressure onto the rear face of the panel 21 and the glued zone 6*c* of the projection 6 is stuck under pressure onto the rear face of the projection 5. Thus, the assembly of the first part of the container of the invention constituted by the flat blank part 31 is obtained in bi-dimensional form.

With reference now to the flat blank part 33, the inner surface of which is shown in plan in FIG. 4, a layer of adhesive, for example of a vinyl or else of the so-called "hot melt" type is applied by hand or machine to the strips 35 and 36.

The flat blank part 31, already assembled as described above, is now superimposed over the open flat blank part 33 in such a manner that the longitudinal score lines B" and E" of the flat blank part 31 coincide with respective longitudinal score lines A and D of the flat blank part 33 and likewise the respective upper edges of the two flat blank parts 31 and 33 coincide. The flat blank part 33 is now folded a first time along the longitudinal score line A and, a second time, along the longitudinal score line D in such a way that its upper glued edge 35 becomes stuck under pressure onto the outside of the zone 32 adjacent the upper edge of the flat blank part 31 and the glued strip 36 of the panel 12' becomes stuck under pressure onto the outside of the opposite flap 34 in such a way as to close the flat blank part 33 and fix it to the flat blank part 31.

The two flat blank parts 31 and 33 are thus assembled and fixed together, giving rise to a flexible two-dimensional container of minimum bulk which can therfore easily be stored, which correspond to the two-dimensional flexible container obtained starting from the unitary flat blank of FIG. 1 except for the absence of the scoring of edge G (see FIG. 2), the two flat blank parts 31 and 33 being rendered rigidly connected together by gluing along the zones 32 and 35 of the said two parts respectively.

The operations for assembly into three-dimensional form, for filling with the desired product, for closure and opening of the container for removing the product contained therein are exactly the same as already described in relation to the flexible two-dimensional container obtained from the unitary flat blank of FIG. 1.

Figure 6:
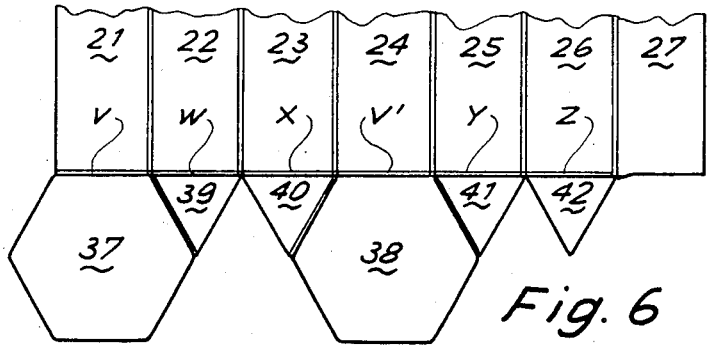
FIG. 6 is a partial plan view of the lower end part of the flat blank of FIG. 1, or of the first part of the flat blank of FIG. 3, intended to form the bottom of the inner part of the container in a variant embodiment.

With reference now to FIG. 6, there is illustrated an alternative embodiment in substitution for the projections 5 and 6 of the lower end part of the unitary flat blank or, in the case of the container obtained starting from two flat blank parts, of the lower end part of the flat blank part intended to form the inner part of the container of the invention.

Figure 7:
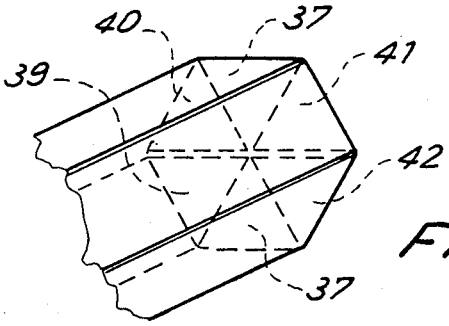
FIG. 7 is a partial perspective view of the assembled bottom of the container according to the variant of FIG. 6.

As illustrated in FIG. 6, the panels 21 and 24 have respective projections 37 and 38 joined to respective panels by transverse score lines V and V' respectively, constituted by identical hexagons having sides of lengths equal to the width of any of the panels from 21 to 26, whilst the panels 22, 23, 25 and 26 have respective projections 39,40,41 and 42 joined to corresponding panels by transverse score lines W,X,Y and Z respectively, constituted by equilateral triangles having sides by length equal to the width of any of the panels from 21 to 26. The rear surface with respect to those illustrated in the drawing, of the triangular projections and/or one of the hexagonal projections are possibly provided with adhesive for the closure of the corresponding end of the container when assembled in three-dimensional form, by folding of the triangular projections towards the interior of the container and subsequent superimposition first of one and then of the other hexagonal projection to obtain the arrangement shown in FIG. 7.

In another variant, illustrated schematically in phantom in FIG. 1, of the lower end part of the unitary flat blank or, in the case of the container obtained starting from two flat blank parts, of the lower end part of the flat blank part intended to form the inner part of the container of the invention, a zone 20' equal to the zone 20 of FIG. 1 is provided between the end parts of the panels from 21 to 26 and the corresponding projections by a score line H', for the purpose of obtaining a suitably raised closed bottom.

Obviously, the hexagonal prismatic form has been illustrated and described by way of example only, nothing preventing the unitary flat blank or the two flat blank parts from being suitably shaped in such a way as to obtained containers of other polygonal sections or entirely of cylindrical form, and it is likewise obvious that numerous constructional variations can be introduced to the container of the invention without however departing from the scope thereof.

Equally, the reference to cardboard as starting material has been made merely by way of example, it being likewise possible to use any other type of suitable material for obtaining the container of the invention.

I claim:

1. At least one flat blank for forming a polygonal container, comprising:

a first rectangular part sub-divided into equal rectangular panels by longitudinal parallel score lines, the first part including at one side a lateral flap of dimensions substantially equal to those of one of the panels and having an opposite face which can be joined by gluing to the panel situated at a side opposite from the lateral flap;

a second central part delimited from the first part by a transverse score line, and partially sub-divided into shaped panels each constituting a prolongation of a respecitve one of the panels of the first part, the shapes of the said shaped panels being defined by empty spaces in the form of isosceles trapezoids of equal dimensions, the longer bases of which are aligned with the parallel longitudinal score lines of the first part and the smaller bases of which have a minimum length, the second central part likewise having, in a portion thereof adjacent the first part, a further transverse score line and longitudinal score lines between the transverse score lines aligned with the corresponding longitudinal score lines of the first part, the shaped panels being transversely traversed in their median part by pairs of closely spaced parallel lines which intersect the ends of the smaller bases of the isosceles trapezoids;

a third part of generally rectangular shape and subdivided for the whole of its length by parallel longitudinal score lines aligned with the corresponding longitudinal score lines of the first part, into identical panels and into a second lateral flap of dimensions substantially equal to those of any of the said identical panels, the second flap being located at one side of the third part and adapted to be glued to a rear face of the identical panel situated at an opposite side from the second flap, and projections foldable along transverse score lines which form sides for connection with suitable panels of the third part of the blank, the projections being adapted to form a transverse wall of the container when the first and third parts are erected with their flaps adhered to their respective panels to form a hollow polygonal cross-sectional container, wherein a first one of the projections is connected to the panel situated at the side opposite from the second flap, the first projection having a substantially trapezoidal form with the smaller angles rounded and including two inclined and symmetrical score lines such as to delimit a remaining part of the projection in such a way as to confer on the remaining part of polygonal form having sides of a length equal to the width of the individual longitudinal panels of the third part and equal in number thereto so that the remaining part is in the final configuration of an adjacent end of the container, and to define two lower lateral guide flaps which bend automatically along their respective score lines when the container is erected, for subsequently facilitating sliding movement of the remaining part within the container and insuring proper closure of the adjacent end of the container, and wherein a second one of the projections is connected by means of a transverse score line to an edge of the panel which is opposite, during assembly of the blank to form the container, to the identical panel intended to be glued to the second flap, the second projection having a polygonal form having sides of a length equal to the width of the individual longitudinal panels and equal in number thereto so that the second projection also is in the final configuration of the adjacent end of the container, and the second projection being sub-divided into two halves by a transverse score line parallel to the edge of the third part of the flat blank, for folding the second projection in half, there being provided on the half of the second projection not connected to the third part a region for the application of adhesive for gluing to the first projection.

2. A dual-blank arrangement for forming a container, comprising two flat blanks forming first and second sections, the first section corresponding to the second and third parts and the projections of the blank as set forth in claim 1, and the second section corresponding substantially to the first part of the blank as set forth in claim 1, each of the sections also including a transversal marginal zone adapted to firmly join the blanks together by gluing.

3. The blank of claim 1 and including between the third part of the flat blank and the projections a transverse strip delimited in height by transverse score lines and longitudinally sub-divided by score lines aligned with the corresponding longitudinal score lines of the flat blank, and adapted to inset the transverse wall of the container formed by erection of the blank, from an adjacent edge of the third part of the blank.

4. A method of erecting the blank of claim 1 comprising the steps of:

folding the first projection of the third part of the flat blank inwards;

folding the half of the second projection adjacent the third part inwards and the other half of the second projection outwards along the transverse median score line;

folding back the first part of the flat blank along the transverse score line between it and the second central part towards the back of the second central and third parts;

folding the flat blank once along a longitudinal score line in such a way that the back of the first projection, folded as described, comes to lie opposed to and in contact with an adhesive layer provided on the inner surface of the other half of the second projection, folded as described, and a second time along a further longitudinal score line in such a way that the glued region of the lateral flap of the third part of the blank coincides with and is glued under pressure to the back of the first panel of the third part, and the back of the glued lateral flap of the first part of the flat blank is superimposed and glued to the panel situated at the opposite end of the first part of the flat blank, thus causing the scoring delimiting the panel of the first part situated at the opposite end from a side border thereof to be coincident with an outer edge of a border of the third part, thus completely surrounding the third and second central parts with the first part of the flat blank and fixing the first and third parts together;

and pressing along the opposed score lines of the two-dimensional flat container thus obtained finally to erect the container into its three-dimensional prismatic form, including bending of the lower lateral guide flaps along their respective score lines, with the container being open at one end and closed at the other by an automatic positioning of a floor constituted by the first and second projections.

5. A method of erecting the dual-blank arrangement of claim 2 comprising the steps of:

folding the first projection on the first section inwards;

folding the half of the second projection adjacent the first section inwards and the other half of the second projection outwards along the transverse median score line;

folding the first section once along a longitudinal score line in such a way that the back of the first projection, so folded is brought to lie opposed to and in contact with an adhesive layer provided on the inner surface of the other half of the second projection, folded as said, and a second time along a further longitudinal score line in such a way that the adhesive zone of the lateral flap of the first section coincides with and is glued under pressure to the back of the first panel of the first section;

superimposing the first section thus folded and glued onto the second section in such a way that the respective upper edges coincide and that the flap of the second section is disposed in such a manner that is partially overlies, by means of subsequent folding of a suitable longitudinal score line of the second section on the back of the lateral flap of the first section, thus causing the scoring delimiting the flap of the second section to coincide with an outer edge of the lateral flap of the first section;

further folding the remaining portion of the second section on the first, thus completely surrounding the first section by the second and fixing the second section to itself and the first section, and pressing along the counterposed scores of the two-dimensional flap container thus obtained finally to erect the container into its three-dimensional prismatic form, including bending of the two lower guide flaps along their respective score lines, with the container being open at one end and closed at the other by the automatic positioning of a floor constituted by the first and second projections of the first section as pré-arranged and rigidly connected together.

6. The container formed from the blank of claim 1, and including a diaphragm device for opening and/or closing one end of the container, which device is constituted by the shaped panels formed by die-cutting of a part of the flat blank, the device being actuated by the sliding of the first part relative to the third part of the flat blank when erected to from the container, with the first part defining an outer part and the third part defining an inner part of the container, the sliding of the outer part of the container on the inner part in the direction of the transverse wall of the container formed by the projections causing the folding of the shaped panels along the respective pairs of transverse parallel score lines which traverse them, to cause the shaped panels to effect a closure movement like closing a book, the shape of the isosceles trapezia empty spaces allowing the displacement of the shaped panels towards the longitudinal axis of the container with the median parts of the shaped panels adjacent that axis, as well as the partial superimposition of the shaped panels, thus causing the closure of the one end of the container with a substantially diaphragm effect, with the shaped panels lying in a plane essentially perpendicular to the axis of the container itself; and sliding of the first outer part of the container on the third inner part in the opposite direction causing opening of the container.

7. At least one flat blank for forming a polygonal container comprising:

a first rectangular part sub-divided into equal rectangular panels by longitudinal parallel score lines, the first part including at one side a lateral flap of dimensions substantially equal to those of one of the panels and having an opposite face which can be joined by gluing to the panel situated at a side opposite from the lateral flap;

a second central part delimited from the first part by a transverse score line, and partially subdivided into shaped panels each constituting a prolongation of a respective one of the panels of the first part, the shapes of the said shaped panels being defined by empty spaces in the form of isosceles trapezoids of equal dimensions, the longer bases of which are aligned with the parallel longitudinal score lines of the first part and the smaller bases of which have a minimum length, the second central part likewise having, in a portion thereof adjacent the first part, a further transverse score line and longitudinal score lines between the transverse score lines and aligned with the corresponding longitudinal score lines of the first part, the shaped panels being transversely traversed in their median part by pairs of closely spaced parallel lines which intersect the ends of the smaller bases of the isosceles trapezoids;

a third part of generally rectangular shape and subdivided for the whole of its length by parallel longitudinal score lines aligned with the corresponding longitudinal score lines of the first part, into identical panels and into a second leateral flap of dimensions substantially equal to those of any of the said identical panels, the second flap being located at one side of the third part and adapted to be glued to a rear face of the identical panel situated at an opposite side from the second flap, and projections foldable along transverse score lines which form sides for connection with suitable panels of the third part of the blank, the projections being adapted to form a transverse wall of the container when the first and third parts are erected with their flaps adhered to their respective panels to form a hollow polygonal cross-sectional container, wherein two panels of the third part of the flat blank, intended to be opposite during assembly of the blank to form the container, each have first and second ones of the projections, each of the first and second projections having a polygonal shape with edges of a length equal to the width of the individual panels of the third part and of equal number so that the polygonal projections are in the final configuration of an adjacent end of the container, and wherein the remaining panels of the third part each have another one of the projections, each of the latter projections being of an equilateral triangular shape having edges of a length equal to the width of any of the panels of the third part, with selected faces of the triangular projections and the polygonal projections being capable of being suitably provided with adhesive for the closure of the adjacent end of the assembled container in three-dimensional form, and all of the projections being connected to the parts of the blank by score lines.

* * * * *